United States Patent [19]

Hoppestad et al.

[11] Patent Number: 4,528,997

[45] Date of Patent: Jul. 16, 1985

[54] ARTICLE SUPPORT RACK

[75] Inventors: Lamont I. Hoppestad; George A. Blanos, both of Louisville, Ky.

[73] Assignee: Corpane Industries, Jeffersontown, Ky.

[21] Appl. No.: 506,032

[22] Filed: Jun. 20, 1983

[51] Int. Cl.[3] ..... B08B 3/10

[52] U.S. Cl. ..... 134/184; 134/85; 134/92; 134/123; 211/41

[58] Field of Search ..... 134/184, 123, 85, 92; 211/41

[56] References Cited

U.S. PATENT DOCUMENTS

| | | | |
|---|---|---|---|
| 1,178,213 | 4/1916 | Campbell | 134/184 |
| 1,356,305 | 10/1920 | Newton | 211/41 |
| 2,406,669 | 8/1946 | Daniels | 211/41 |
| 2,433,823 | 12/1947 | Lindeblad | 211/41 |

FOREIGN PATENT DOCUMENTS

| | | | |
|---|---|---|---|
| 46-7105 | 3/1971 | Japan | 134/184 |
| 340490 | 12/1930 | United Kingdom | 211/41 |

*Primary Examiner*—Stephen Marcus
*Assistant Examiner*—Renee S. Kidorf
*Attorney, Agent, or Firm*—Charles G. Lamb

[57] ABSTRACT

A rack for supporting articles being surface treated includes a device for locating and supporting at least two rows of articles with the articles of one row being in alternating, staggered and partially overlapping relationship with the articles of the other row. Preferably, the article rack is used in high volume manufacturing processes wherein a plurality of articles to be treated are placed on the rack which is immersed in a treating solution. The structure of the rack in combination with solution vibrating means enables the articles to be supported, separated and treated.

13 Claims, 5 Drawing Figures

ARTICLE SUPPORT RACK

BACKGROUND OF THE INVENTION

1. Field of the Invention

The present invention relates to racks for holding articles, and more particularly to an article rack for locating and supporting a plurality of articles during the performance of a surface treating process on the articles with a majority of the surface area of the articles exposed to the action of the process. Even more particularly, a vibrating means is included in combination with a rack locating and supporting device to separate the articles during the treatment.

2. Description of the Prior Art

During a process of manufacturing articles, it is often required that the articles be surface treated in some manner. Such surface treatments typically include cleaning the surface of the articles to remove oil and particles, or the coating of the surface of the articles with a protective or decorative material.

Typically, in a high volume manufacturing operation, the articles to be surface treated are placed in bulk in a bath of cleaning or coating solution. However, this method does not always allow for the proper article surface treatment, particularly of articles having planar surfaces, for the reason that the articles may stick together or lay upon each other in the bath thereby precluding adequate exposure of the interfacing surfaces to the surface treating material.

Any proposed solution to this problem must satisfy a number of criteria. For example, it must be capable of rapid implementation so as not to add any significant time to the manufacturing process. Further, any proposed solution must be relatively inexpensive to make, in the first instance, and require little maintenance to keep in operation.

The present invention recognizes these requirements and provides a solution to the problem which facilitates the rapid separation and surface treatment of articles. The present invention provides a rack device for locating and supporting articles during a surface treatment process being performed on the articles which exposes the surface thereof to be treated, which is simple to use and relatively inexpensive to make and maintain in operation.

More particularly, the present invention provides a rack for holding and separating articles during a treatment process being performed on the articles comprising means for supporting and alternately separating adjacent rows of articles with the articles of one row being in alternating, staggered relationship with the articles of the other row. Preferably the rack is disposed within a tank having a treating solution therein wherein the treating solution or the articles therein are subjected to vibrating means.

Also, the present invention provides a method for treating articles comprising the steps of: placing a plurality of articles to be treated in a tank having a rack for holding and separating articles, said tank having a treating solution therein; vibrating said treating solution or said articles whereby during said vibrating, said articles separate; and, removing said articles from said tank after a preselected period of time.

In the use of the term "row" or "rows" herein, it is understood that a "row" may consist of at least one article and that "rows" may consist of at least one article in each of at least two rows.

In the use of the phrase "surface treatment" herein, it is understood that this includes, but is not limited to, treatment of articles for further processing as well as the treatment of the surfaces of the articles immersed within the treating solution.

BRIEF DESCRIPTION OF THE DRAWINGS

A better understanding of the present invention will be had upon reference to the following discussion in conjunction with the accompanying drawings in which like numerals refer to like parts throughout the several views and wherein.

DETAILED DESCRIPTION OF THE PREFERRED EMBODIMENTS

Figure 3:
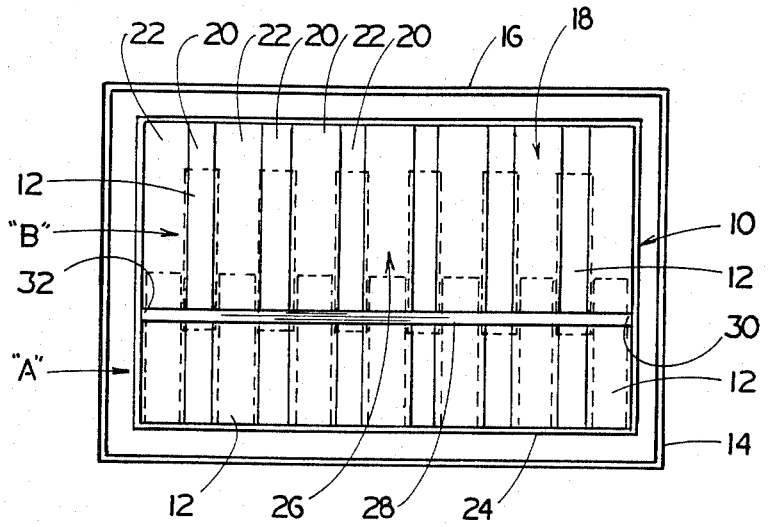
FIG. 3 is a top plan view of the present invention as viewed in the direction of arrows 3—3 in FIG. 1.
Figure 1:
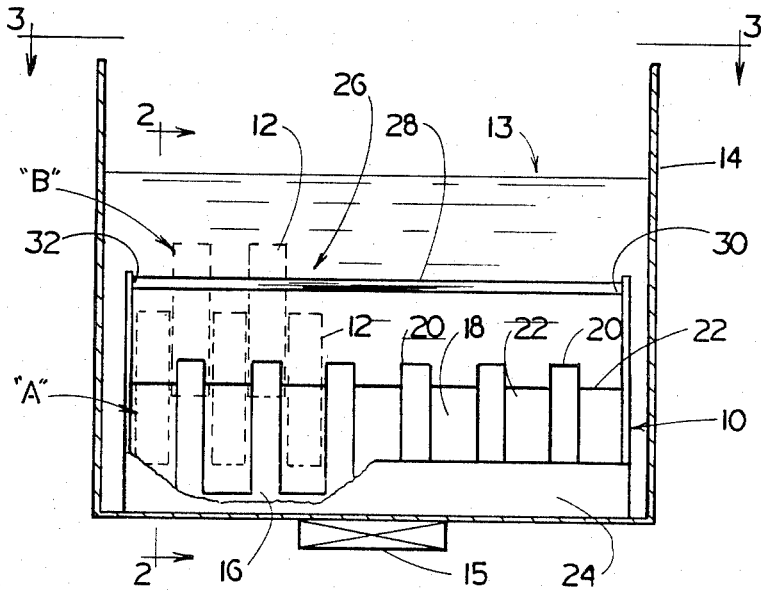
FIG. 1 is a front view of the present invention, partially broken away to show details.
Figure 2:
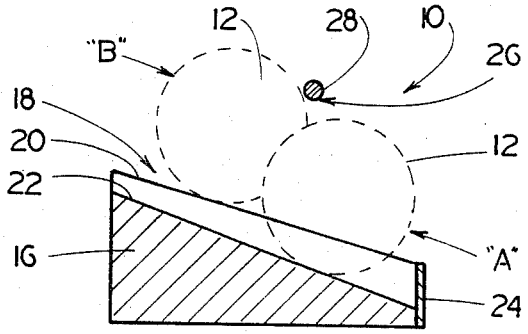
FIG. 2 is a cross-sectioned side view of the present invention as viewed in the direction of arrows 2—2 in FIG. 1.

With reference to FIGS. 1 through 3, there is shown a rack, generally denoted by the numeral 10, of the present invention for locating and supporting articles 12 (shown in broken lines) during a surface treatment process. As illustrated in FIGS. 1—3, the rack 10 is used to locate and support the articles 12 in a treating tank or chamber 14 containing a surface treating solution 13 and a solution or article vibrating means, such as, an ultrasonic transducer identified by the numeral 15. The surface treatment can be, for example, a surface cleaning process, a surface coating process, a process combining surface cleaning and coating, or preparation for further processing of the articles. And, the ultrasonic transducer 15 may be operable in response to any well known ultrasonic generating device (not shown). Also, solution 13 generally completely covers the articles 12 during the surface treatment thereof.

As shown in FIGS. 1–3, the rack 10 comprises article locating and support means in the form of a base member 16 having an upper article support surface 18 slanted to the horizontal. The upper article support surface 18 includes a plurality of lands 20 and grooves 22 extending longitudinally of the slanted surface 18. As can be best seen in FIG. 1, each of the lands 20 are generally narrower than the grooves 22 and the total width of each land 20 and one of its adjacent grooves 22 is approximately the same width as two adjacent articles 12 to be supported and separated. With reference to FIG. 2, the base member 16 further includes stop means in the form of a wall 24 extending across the width of the base member 16 at the low end of the slanted surface 18 closing the end of the grooves 22.

As shown in FIGS. 1–3, the rack 10 is located at the bottom of the treating chamber 14 with the standard article support surface 18 facing generally upward. As illustrated, the articles 12 being treated are disposed in at least two rows denoted, respectively, by the letters "A" and "B" on the article support surface 18. Each one of the articles 12 of the first row "A" are received in a different one of the grooves 22 such that they are spaced apart along the width of the locating and supporting base member 16 and are laterally held in position by the walls of the grooves 22. Each of the articles 12 in the grooves 22 abutts the stop wall 24 which prevents them from moving longitudinally out of the grooves 22. Each one of the articles 12 of the second row "B" is supported on a different one of the lands 20 and are, thus, each located between a different pair of adjacently located, spaced apart articles 12 of the first row "A" so that they are mutually spaced apart along the width of the locating and support base member 16. The articles 12 of the row "B" slightly overlap the articles 12 of the row "A" and are thereby laterally held in position by the articles 12 of row "A".

Due to the slant of the upper surface 18 of the base member 16, the articles 12 will tend to move down the slanted surface 18 under the influence of gravity and the vibrations in the treating solution. In order to hold the articles 12 of row "B" above the articles 12 of row "A" and from moving into the spaces between the articles 12 of row "A", the rack 10 of the present invention includes an article restraining means, generally denoted as the number 26. As illustrated in FIGS. 1–3, the article restraining means 26 includes a bar 28 located parallel to the second row "B" of articles to abutt each of the articles 12 in the row "B" to prevent them from moving down the slanted surface 18. The article restraining bar 28 is disposed to allow the articles 12 of row "B" to overlap the articles 12 of row "A" by a predetermined amount. The restraining bar 28 can be attached at its opposite ends 30 and 32 to the walls of the rack 10 by virtually any conventional or otherwise convenient means.

It is readily seen in FIGS. 1–3 that the articles 12 are located by and supported on the base member 16 in at least two generally parallel rows wherein the articles 12 of one row, for example row "B", are in alternating, staggered relationship with the articles 12 of the other row, for example, row "A".

It can further be seen that the articles 12 of row "B" are also located above the articles 12 of row "A". Thus, the present invention provides for locating and holding a large number of articles 12 in a treating chamber 14 with at least a major portion of the surface area of each article exposed to the surface treating solution 13 in the chamber 14.

To use the rack 10, the articles 12 are placed in the rack 10. Usually, the articles 12 stick together and the articles 12 of row "A" are disposed above the grooves 22 with the articles 12 of row "B" being supported by the lands 20. The vibrating means is then activated and the vibrations in the solution 13 create a vibrating action upon the articles 12 whereby articles 12 in row "A" are dislodged and drop into the appropriate grooves 22. After the surface treating process is completed, the articles are removed from the rack 10 and the treatment chamber 14.

Figure 4:
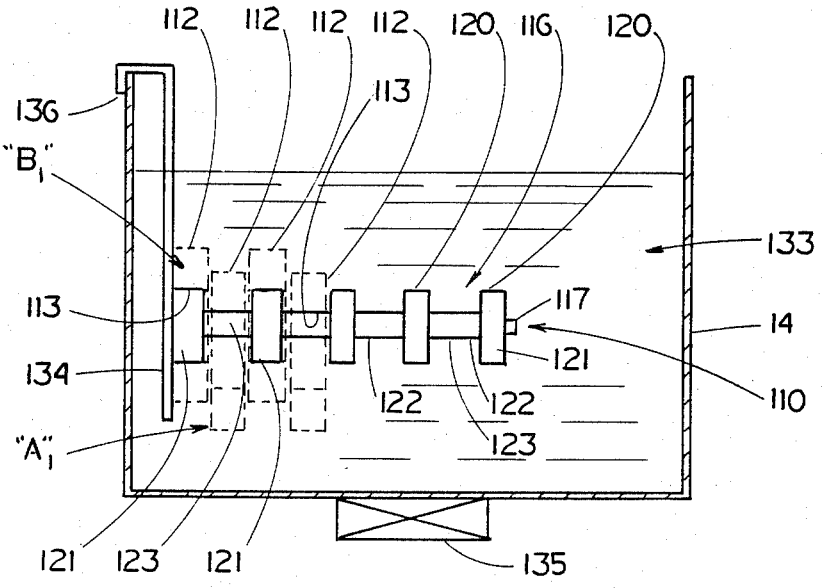
FIG. 4 is a side view of another embodiment of the present invention.
Figure 5:
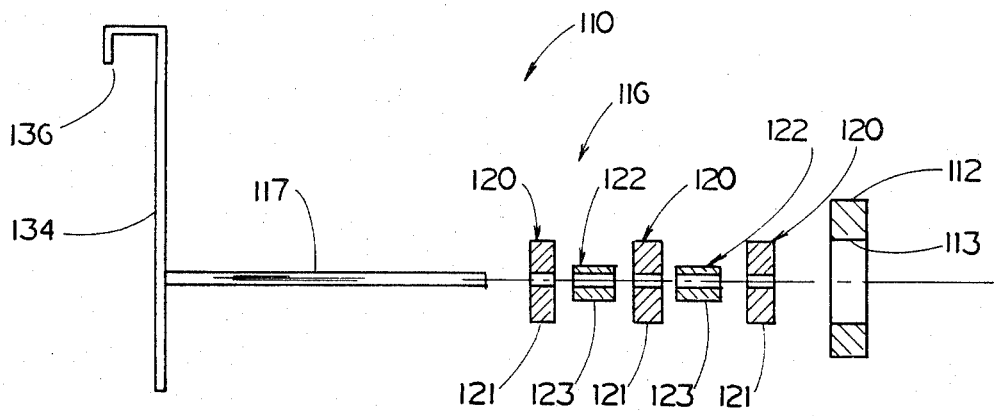
FIG. 5 is an exploded side view, partially in cross-section, of the embodiment of FIG. 4.

FIGS. 4 and 5 illustrate another advantageous embodiment of the present invention shown as a rack, generally denoted as the number 110, for locating and supporting a plurality of articles 112 to be surface treated. The articles 112, in this instance are washer-like plates, i.e., they have an aperture 113 therethrough. The rack 110 comprises article locating and support means in the form of an elongated beam member 116 having a plurality of lands 120 and grooves 122. The beam member 116 can, as shown, include a straight armature bar 117 having coaxially received, alternating circular collars 121 and 123 of two different outside diameters. For example, the collars 121 are of larger outside diameter than are the collars 123. The outside surfaces of the larger collars define the lands 120 and the outside surfaces of the smaller collars 123 define the grooves 122. The lands 120 are narrower than the grooves 122 and the total width of a land 120 and an adjacent groove 122 is substantially the same width as two adjacent articles 112 to be treated. Further, the outside diameter of the larger collars 121 is slightly smaller than the aperture 113 in the articles 112. Alternatively, the beam member 116 can be a unitary construction wherein the grooves 122 are machined or otherwise cut into the material of the beam member 116.

The treating chamber 14 also includes a surface treating solution 133 therein and a solution vibrating means exemplified as an ultrasonic transducer 135. Ultrasonic transducer 135 is operable in response to actuation of an appropriate ultrasonic generating means (not shown). And, the treating solution 133 is generally sufficient to completely cover the articles 112 during surface treatment.

As can be best visualized by reference to FIG. 4, the articles 112 to be treated are slid onto the beam member 116 with the aperture 113 receiving an appropriate collar 121 or 123. The articles 112 being surface treated are disposed in at least two rows respectively denoted by the letters "$A_1$", and "$B_1$", on the article locating and supporting beam member 116. Each one of the articles 112 of the first row "$A_1$", during treatment is located over a different one of the smaller collars 123 with the margin of the aperture 113 of the articles received in the groove 122 defined by that collar 123 such that the articles 112 are spaced apart along the length of the beam member 116 and are laterally held in place by the walls of the grooves 122. Each one of the articles 112 of the second row "$B_1$", is located over a different one of the larger collars 121 with the margin of the aperture 113 of the article located on the lands 120 defined by that collar such that articles 112 of the second row "$B_1$", are each located between a different pair of adjacently located, spaced apart articles 112 of the first row "$A_1$", and are also spaced apart along the length of beam member 116. The articles 112 of the row "$B_1$", slightly overlap the articles 112 of the row "$A_1$", and are thereby laterally held in position by the articles 112 of the row "$A_1$".

As shown in FIGS. 4 and 5, the rack 110 also includes a means, such as a hanger bar 134, for suspending the rack 110 in the treatment chamber 14. Hanger bar 134 provides means for the positioning of the rack 110 in the treating chamber 14. The hanger bar 134 is shown as being attached to one end of the beam member 116 and extending generally perpendicular to the beam member 116. The hanger bar 134 can include fastener means, such as for example, a hook 136 at the free end thereof, for the attachment of the rack 110 to a wall of the treating chamber 14 so the beam member 116 will be generally horizontally disposed within the treating chamber 14.

As can be seen in FIG. 4, the articles 112 during treatment are supported on the locating and support beam member 116 in at least two generally parallel rows wherein the articles 112 of one row, for example row "$B_1$", are in alternating, staggered relationship with the articles 112 of the other row "$A_1$". It can also be seen that the articles 112 of row "$B_1$", are located generally above the articles 112 of row "$A_1$". Therefore the rack 110 of the present invention provides for holding and locating a large number of articles 112 in a treatment chamber with, at least, a major portion of the surface area of each article exposed to the treating material in the chamber 14.

To use the rack 110, the articles 112 are placed on the beam member 116 row "$B_1$", being supported by the lands 120 and row "$A_1$" being immediately above the grooves 122. Lands 120 are defined by the outer periphery of the larger collar 121 and the grooves 122 are defined by the outer periphery of the smaller collar 123. The filled rack 110 is then lowered into the treatment chamber 14 and the ultrasonic transducer 135 is actuated. The vibrations set up in the solution 133 by the action of the transducer 135 create a vibrating action upon the articles 112 thereby dislodging the articles in row "$B_1$" from adjacent articles in row "$A_1$". The treating utilizing the vibrating means is then continued for a preselected period of time, the preselected period of time being sufficient to treat the articles 112 therein. After the surface treating process is completed, the rack 110 is raised out of the chamber 114 and the articles are removed from the rack. In the alternative, it is realized that the rack 110 may be placed in the chamber 114 before the articles are added and the rack 110 may be left in the chamber after the articles are removed.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A rack for holding articles for treatment comprising:

article locating and support means for supporting and separating at least two rows of articles, the article locating and support means including means defining a plurality of lands and grooves, wherein the articles of one row are supported by the lands and the articles of the other row are supported in the grooves such that the articles of one row are in alternating, staggered relationship with the articles of the other row, the article locating and support means is slanted to the horizontal so that one of the rows of articles to be supported thereon is located generally above the other row of articles to be supported thereon; and, article restraining means for restraining the articles in the higher row from moving out of position down the slanted locating and support means.

2. The rack of claim 1, wherein the article locating and support means provides for the articles of one row to overlap the articles of the other row by a predetermined amount.

3. The rack of claim 1, wherein the lands and grooves are longitudinally slanted to the horizontal.

4. The rack of claim 3, wherein the article locating and support means further comprises article stop means closing the ends of the grooves at the low side of the slanted surface.

5. The rack of claim 1, wherein the restraining means is located above the lands by a distance less than the height of the articles supported on the lands, and above the grooves by a distance greater than the height of the articles supported in the grooves.

6. The rack of claim 1, wherein the lands are narrower in width than the grooves and the total width of a land and an adjacent groove is substantially the same width as two adjacent articles to be treated.

7. A surface treating apparatus for articles comprising:

a treating tank;

surface treating solution in said tank;

means for vibrating said solution or said articles; and, a rack for holding articles deposed within said tank, said rack including article locating and support means for supporting and separating at least two rows of articles, the article locating and support means defining a plurality of lands and grooves, wherein the articles of one row are supported by the lands and the articles of the other row are supported in the grooves such that the articles of one row are in alternating, staggered relationship with the articles of the other row, the article locating and support means is slanted to the horizontal so that one of the rows of articles to be supported thereon is located generally above the other row of articles to be supported thereon, and said rack including article restraining means for restraining the articles in the higher row from moving out of position down the slanted locating and support means.

8. The surface treating apparatus of claim 7, wherein the article locating and support means provides for the articles of one row to overlap the articles of the other row by a predetermined amount.

9. The surface treating apparatus of claim 7, wherein the lands and grooves are longitudinally slanted to the horizontal.

10. The surface treating apparatus of claim 9, wherein the article locating and support means further comprises article stop means closing the ends of the grooves at the low side of the slanted surface.

11. The surface treating apparatus of claim 7, wherein the restraining means is located above the lands by a distance less than the height of the articles supported on the land, and above the grooves by a distance greater than the height of the articles supported in the grooves.

12. The surface treating apparatus of claim 7, wherein the lands are narrower in width than the grooves and the total width of a land and an adjacent groove is substantially the same width as two adjacent articles to be treated.

13. The surface treating apparatus of claim 7, wherein the surface treating solution completely covers the rack and the articles to be treated.

* * * * *